US005953989A

United States Patent [19]

Uchiyama et al.

[11] Patent Number: 5,953,989

[45] Date of Patent: Sep. 21, 1999

[54] METHOD AND APPARATUS FOR PRESSURE TYPE STENCIL PRINTING

[75] Inventors: Kouichi Uchiyama; Junnosuke Katsuyama, both of Inashiki-gun, Japan

[73] Assignee: Riso Kagaku Corporation, Tokyo, Japan

[21] Appl. No.: 08/948,301

[22] Filed: Oct. 10, 1997

[30] Foreign Application Priority Data

Oct. 12, 1996 [JP] Japan ..... 8-289293

[51] Int. Cl.[6] ..... B41M 1/12

[52] U.S. Cl. ..... 101/129; 101/127.1; 101/327

[58] Field of Search ..... 101/115, 126, 101/127.1, 129, 327, 389.1; 417/460, 466, 468, 470

[56] References Cited

U.S. PATENT DOCUMENTS

| | | | |
|---|---|---|---|
| 1,013,200 | 7/1912 | Menningen | 417/466 |
| 1,417,677 | 5/1922 | Key | 417/460 |
| 3,221,648 | 12/1965 | Weiss . | |
| 3,372,638 | 3/1968 | Tripp et al. . | |
| 4,128,057 | 12/1978 | Hayama et al. . | |
| 4,475,758 | 10/1984 | Kennell et al. | 101/389.1 |
| 4,843,961 | 7/1989 | Smith . | |
| 4,998,470 | 3/1991 | Klemm | 101/115 |
| 5,050,498 | 9/1991 | Smith . | |
| 5,472,322 | 12/1995 | Huet et al. | 417/470 |
| 5,582,104 | 12/1996 | Best et al. | 101/127.1 |
| 5,596,925 | 1/1997 | Hasegawa . | |

FOREIGN PATENT DOCUMENTS

| | | |
|---|---|---|
| 0 615 842 A1 | 9/1994 | European Pat. Off. . |
| 54-23601 | 8/1979 | Japan . |
| 6-270523 | 9/1994 | Japan . |
| WO 86/02596 | 5/1986 | WIPO . |

*Primary Examiner*—Eugene Eickholt
*Attorney, Agent, or Firm*—Pillsbury Madison & Sutro LLP

[57] ABSTRACT

A stencil printing apparatus is provided, which comprises a pressure chamber the wall of which is partly constituted by a flexible sheet member, a mount which is disposed in the pressure chamber opposite to the flexible sheet member and on which an article to be printed is placed, a frame for supporting a stencil between the flexible sheet member and the mount, and a pump for reducing pressure in the pressure chamber, in which the pump for reducing pressure is an air pump which comprises a cylinder connected to the pressure chamber and a piston slidably disposed in the cylinder. Stencil printing can be quickly and readily effect by pressure reduction in the pressure chamber. The printing apparatus can be small-sized, lightweight and simplified as a whole, and is improved in operatability.

12 Claims, 9 Drawing Sheets

METHOD AND APPARATUS FOR PRESSURE TYPE STENCIL PRINTING

Figure 1:
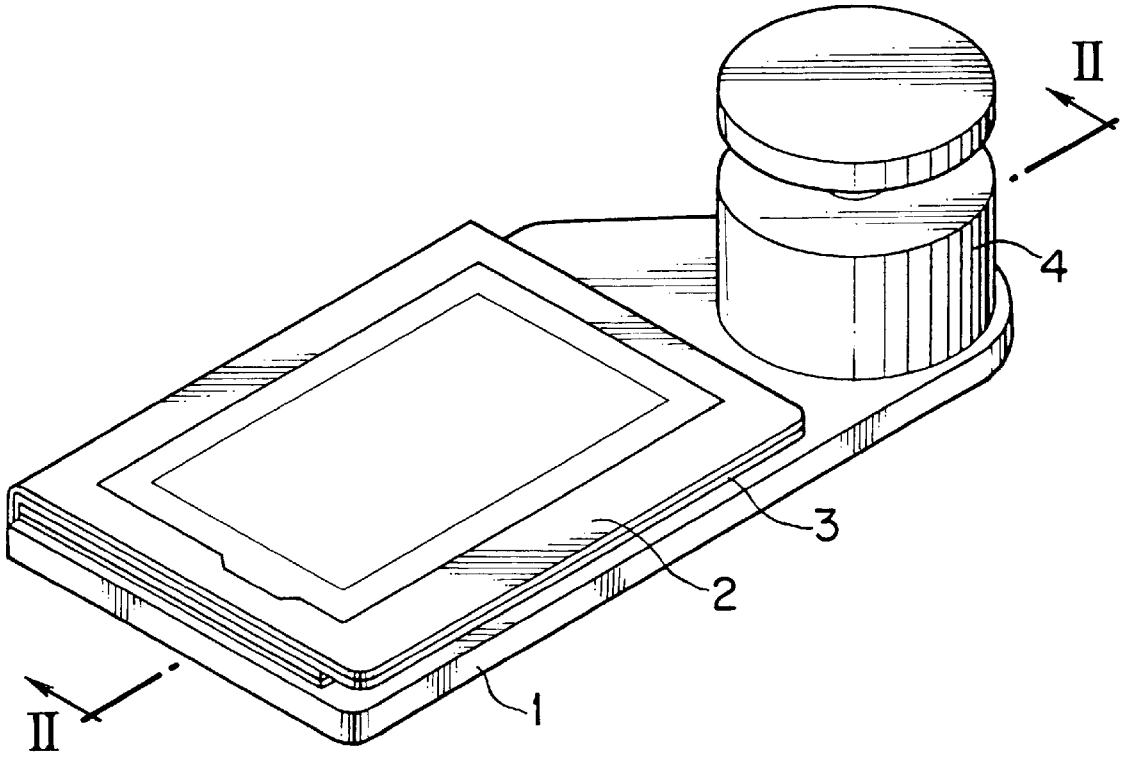

The present invention relates to a method and an apparatus for stencil printing, and more specifically relates to stencil printing in which pressure is reduced in a pressure chamber the wall of which is partly composed of a flexible sheet member, so that the flexible sheet member is brought into close contact with ink lumps placed on a stencil so as to press the ink and transfer it through the perforated portions of the stencil to an article to be printed.

A basic concept of a pressure type stencil printing apparatus having the above type of pressure chamber is already suggested in Japanese Patent Laid-open No. 270523/94 which corresponds to U.S. Pat. No. 5,596,925. This stencil printing apparatus comprises a pressure chamber the wall of which is partly constituted by a flexible diaphragm, and a pressure reducing means connected to the pressure chamber, and is characterized in that stencil printing is readily and quickly effected with desired and uniform density even on large printing surfaces.

However, if such stencil printing apparatus is adapted to a large printing surface, it inevitably becomes large-scale and requires a large-sized pressure reducing means such as vacuum pumps, particularly those used in fan motors. Such large-sized vacuum pumps effect pressure reduction at a constant rate. Thus, they are disadvantageous in that they take much time to create a pressure sufficient to effect printing, are difficult to accurately adjust pressing force, and require much time for operation as well as complicated operation procedure.

It is an object of the present invention to provide stencil printing method and apparatus of the type mentioned above, which can quickly and readily effect pressure reduction, is small-sized, lightweight and simplified in whole, and is improved in operatability.

According to the present invention, the above object is attained by a stencil printing method which comprises

- placing a lump of printing ink on a side of a stencil, said printing ink having a consistency sufficient to retain its shape,
- disposing said stencil in a pressure chamber the wall of which is partly constituted by a flexible sheet member, while the side of said stencil on which said printing ink has been placed, faces said flexible sheet member, and
- reducing pressure in said pressure chamber to bring the flexible sheet member into close contact with the lump of printing ink and simultaneously bring the stencil into close contact with a surface to be printed, so that stencil printing is effected on the surface by virtue of pressing force exerted by the flexible sheet member,
- characterized in that pressure in the pressure chamber is reduced by means of an air pump which comprises a cylinder connected to said pressure chamber and a piston slidably disposed in said cylinder.

The present stencil printing method can advantageously be practiced by a stencil printing apparatus which comprises

- a pressure chamber the wall of which is partly constituted by a flexible sheet member,
- a mount which is disposed in said pressure chamber opposite to said flexible sheet member and on which an article to be printed is placed,
- means for supporting a stencil between said flexible sheet member and said mount, and
- means for reducing pressure in the pressure chamber,
- in which said means for reducing pressure is an air pump which comprises a cylinder connected to said pressure chamber and a piston slidably disposed in said cylinder.

In the present invention, the term "flexible sheet member" should be construed to include not only a sheet member that can be deformed plastically, but also an elastic sheet member, and for example includes sheet members made of soft polyvinyl chloride, rubbers or the like.

According to the present invention, operators can reduce pressure in the pressure chamber with increasing speed instantaneously by pushing or pulling the piston of the air pump. Thus, printing is effected efficiently, and the printing apparatus as a whole can be made simple, lightweight and small.

In the present invention, the piston of the air pump preferably has a piston rod extending outwardly of the cylinder, so that pressure in the pressure chamber can be manually reduced by operating the piston rod. In this case, the manual operation of the piston rod facilitates minute adjustment of degree of pressure reduction, and can prevent excessive pressure reduction. Preferably, the piston rod is provided at its end outside of the cylinder with a handle which can be operated by a hand, and is provided with a spring between the piston and the cylinder to bias the piston rod in one direction. The piston rod may be connected at an end outside of the cylinder to a link mechanism which reciprocates the piston.

In the present invention, the air pump preferably comprises a sealed chamber of variable volume which is defined by the cylinder and the piston and connected to the pressure chamber. In this case, the sealed chamber and the pressure chamber, both of which are interconnected, form a closed circuit upon printing. Thus, it is desired that the volume of the pressure chamber and the stroke volume of the sealed chamber are properly designed in order to obtain pressure reduction sufficient to achieve printing. Advantageously, the sealed chamber has a volume that meets the following equation (1):

$$V_1/V_2 \geqq 1 \tag{1}$$

wherein $V_1$ is a stroke volume of the sealed chamber, and $V_2$ is a volume of the pressure chamber in which said stencil has been disposed. Herein, the term "stroke volume" of the sealed chamber means a volume which is obtained by subtracting the minimum volume of the sealed chamber from the maximum volume of the same. In the above equation (1), the volume of the pressure chamber includes a volume of a conduit that connects the pressure chamber and the sealed chamber as well as the minimum volume of the sealed chamber. In this case, one stroke of the piston rod is sufficient to cause the pressure chamber to be depressurized to a pressure appropriate to effect printing, and thus operation efficiency of printing is improved.

Since the pressure chamber is depressurized by means of an air pump according to the present invention, the smaller, the volume of the pressure chamber is, the lighter and smaller, the air pump and the apparatus as a whole become. Such a pressure chamber of small volume can be constructed by

- a platform having a central portion on which a sheet to be printed is placed and a plane portion which surrounds said central portion,
- a frame member which is a sheet laid on said plane portion and having an opening that faces said central portion,
- a flexible sheet member which is laid on said frame member to cover said opening,
- said flexible sheet member being hinged at an end thereof to said platform so as to be turned up and down, said frame member being hinged at an end thereof to said platform so as to be turned up and down, and said stencil supporting means being a shoulder portion which is formed by extending an inner edge portion of said frame member inwardly of said opening on a side of the platform.

The pressure chamber as above has a three-layer structure which consists essentially of a platform, and a sheet-like frame member and a flexible sheet member which are both hinged to the platform, and thus is characterized in that the interior space of the pressure chamber is minimized and can be depressurized by means of a pressure reducing means of small volume. The pressure chamber is suitable to be depressurized by an air pump mentioned above, but may be depressurized by use of other pressure reducing means. A stencil can readily be installed in the pressure chamber by opening the flexible sheet member, placing the edge portion of the stencil on the shoulder portion of the frame member, and returning the flexible sheet member onto the frame member. In the same manner as above, ink can be supplied to the stencil. Upon printing, articles to be printed can be placed on the platform after the frame member is turned up together with the flexible sheet member from the platform. Thus, printing can be carried out efficiently.

Figure 2:
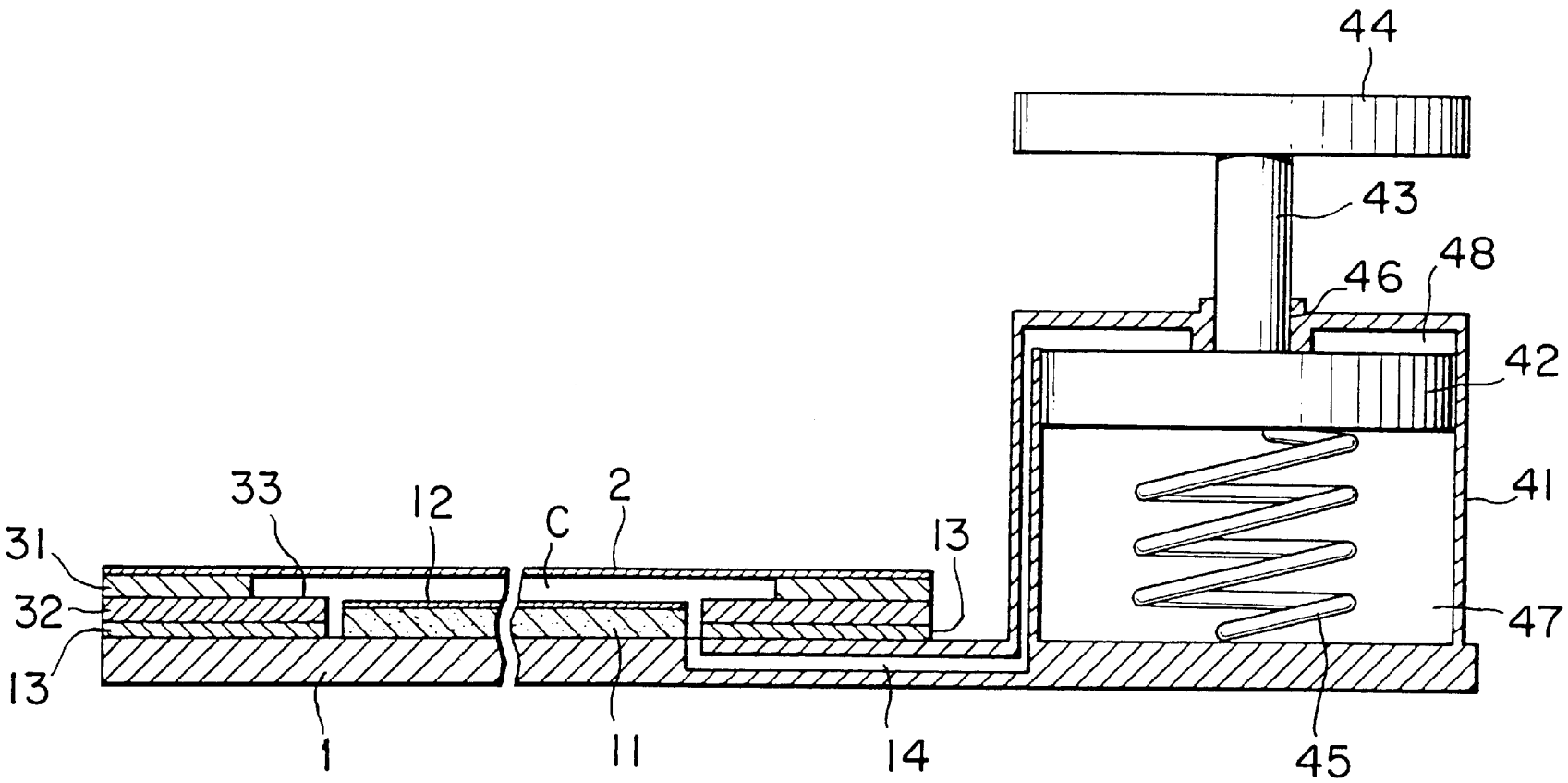
Figure 3:
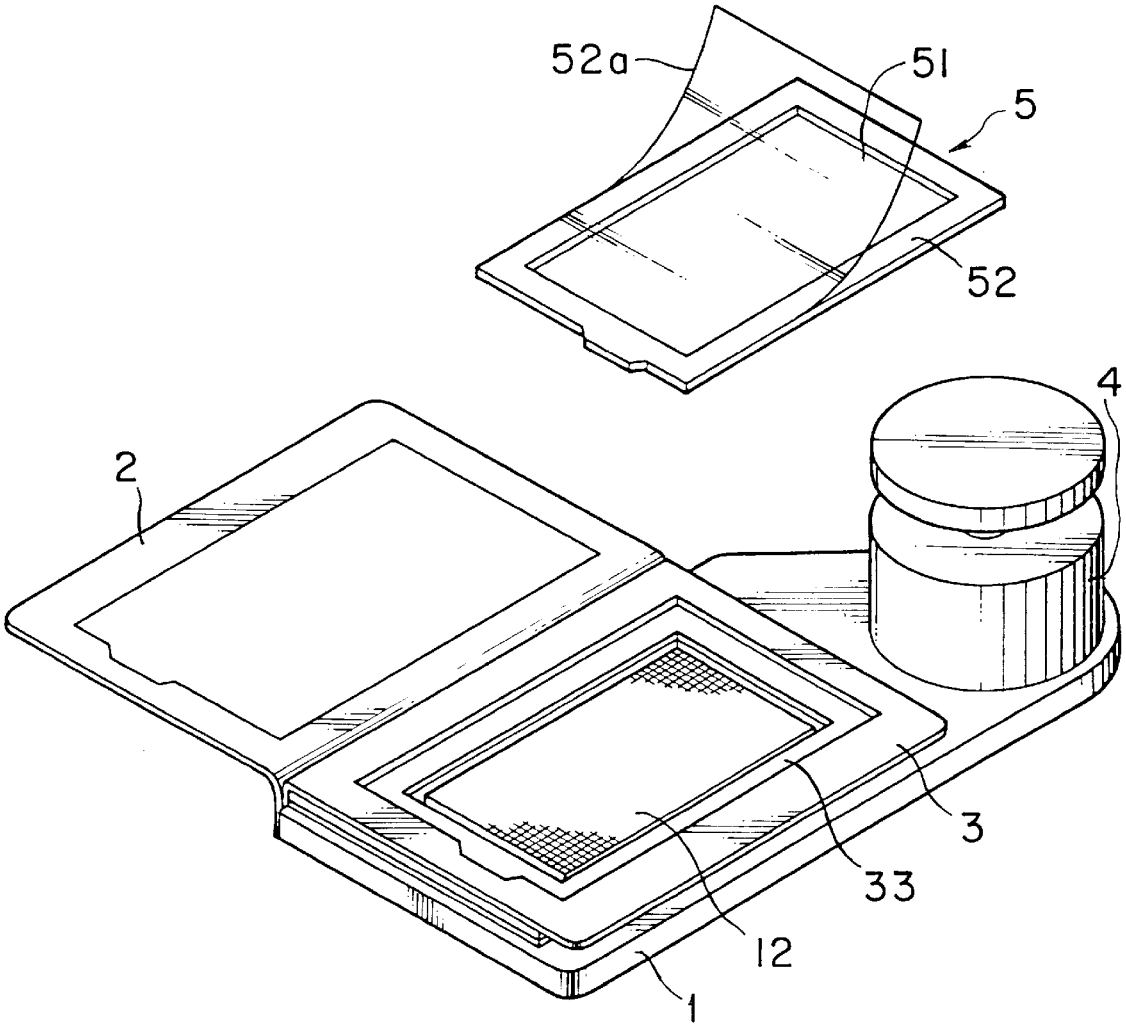
Figure 4:
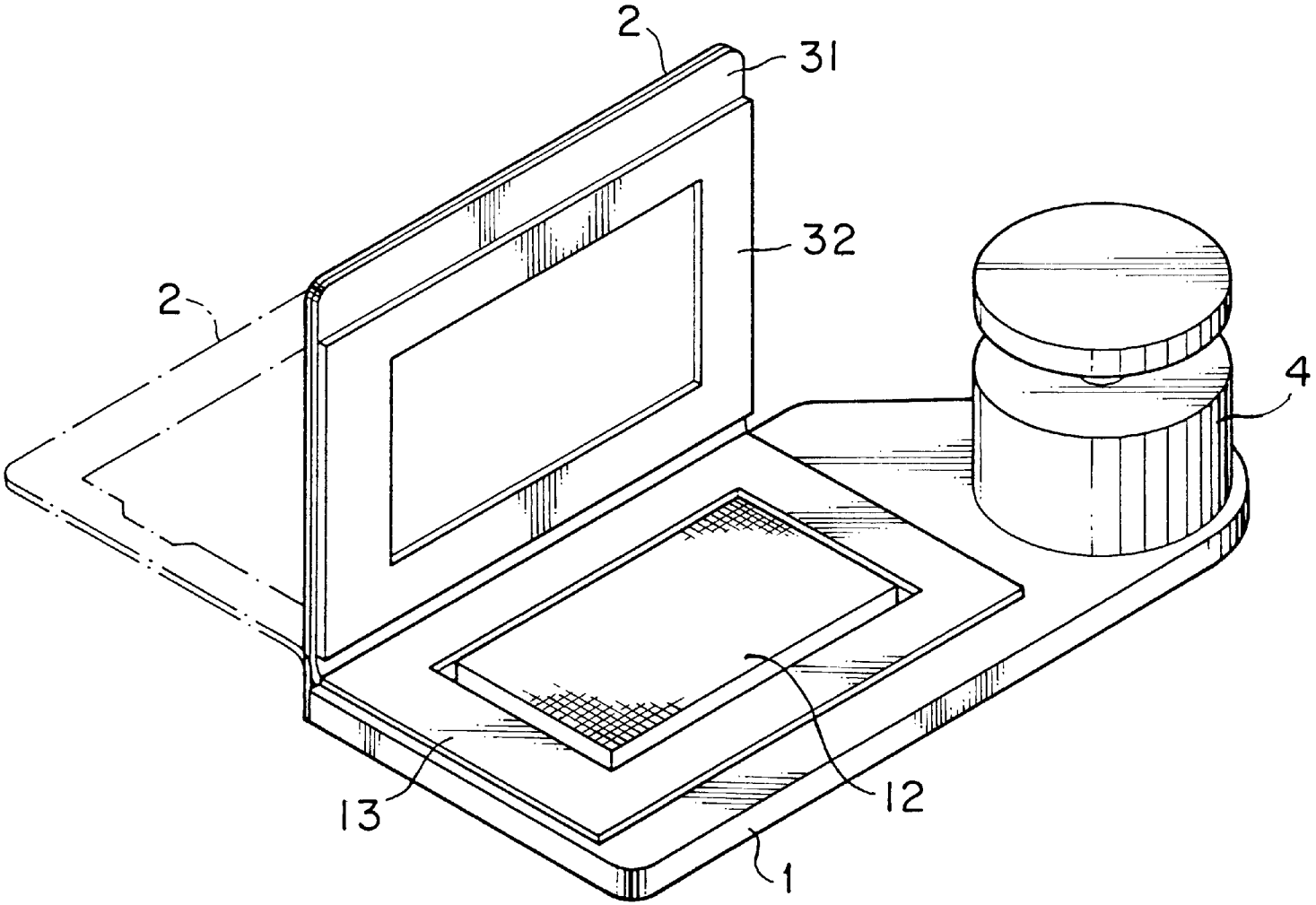
Figure 5:
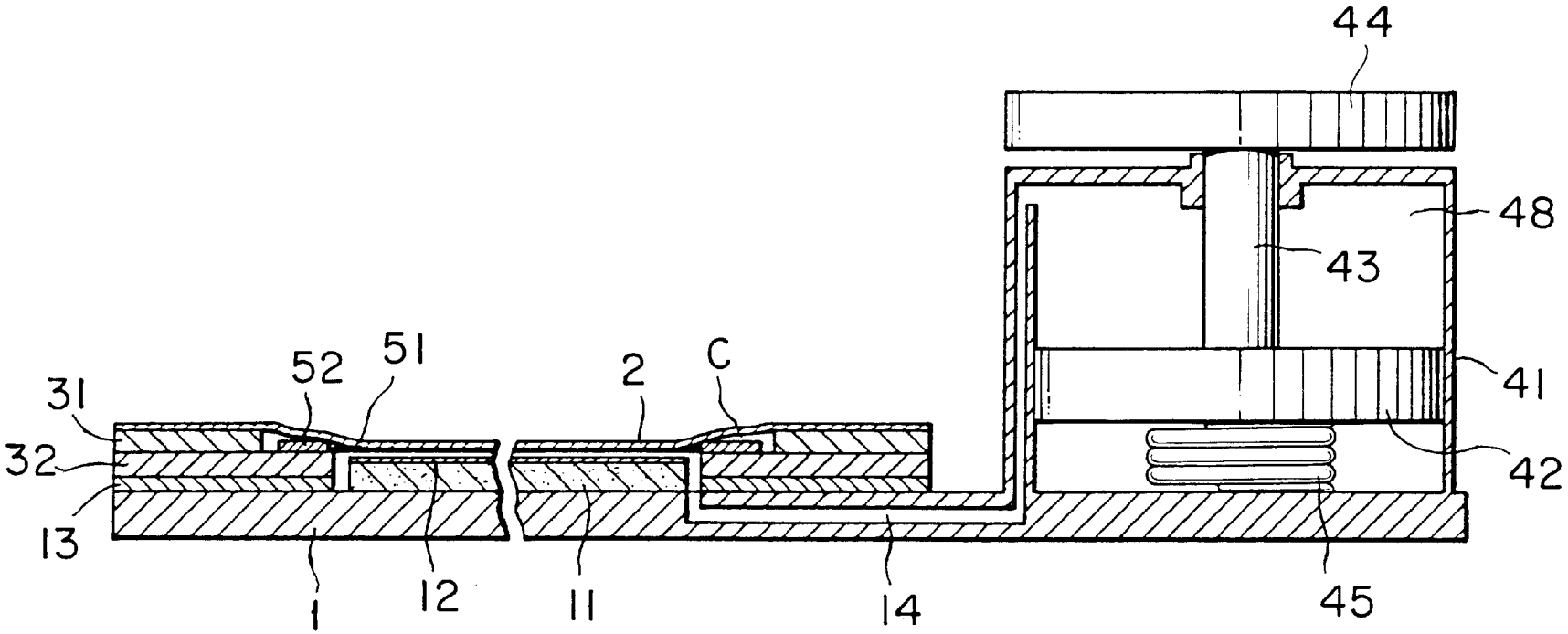
Figure 6:
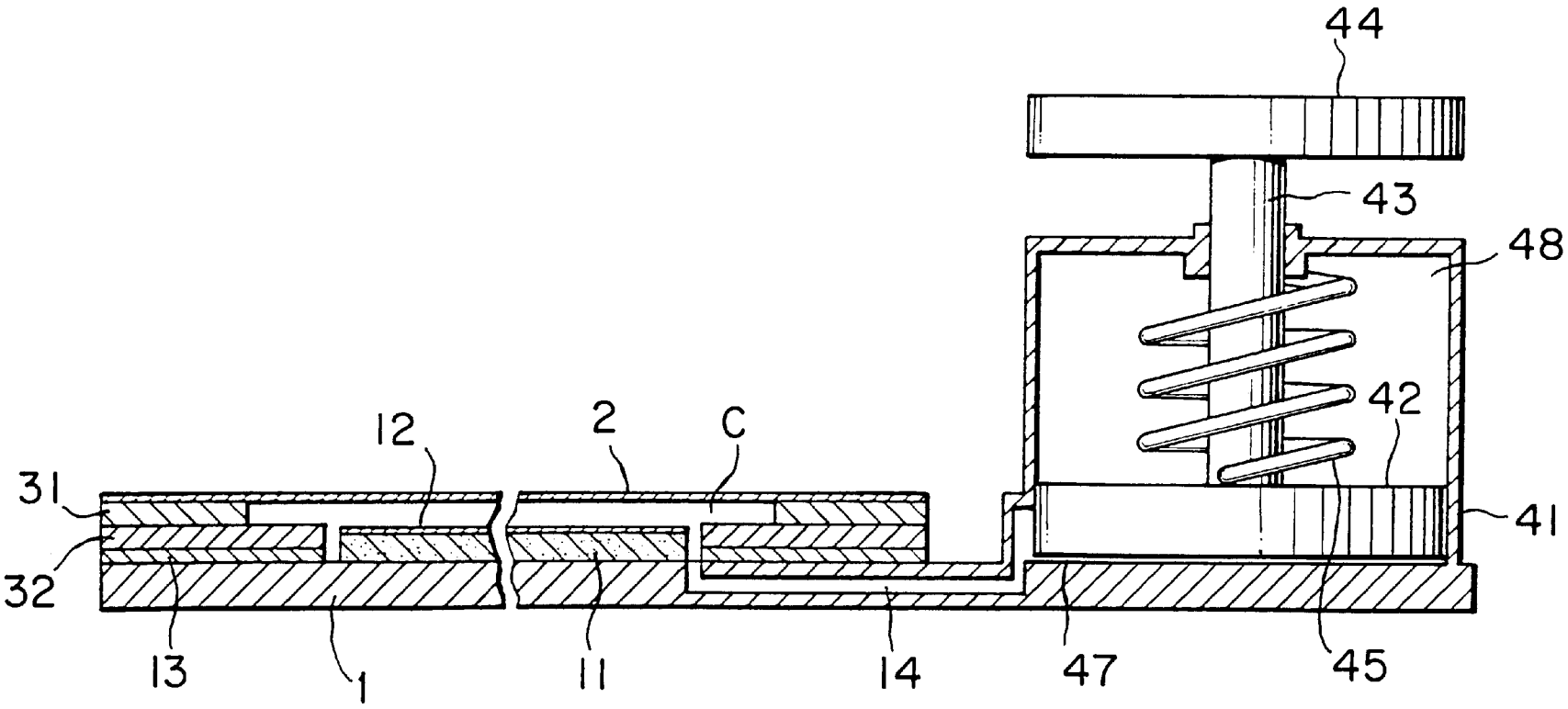
Figure 7:
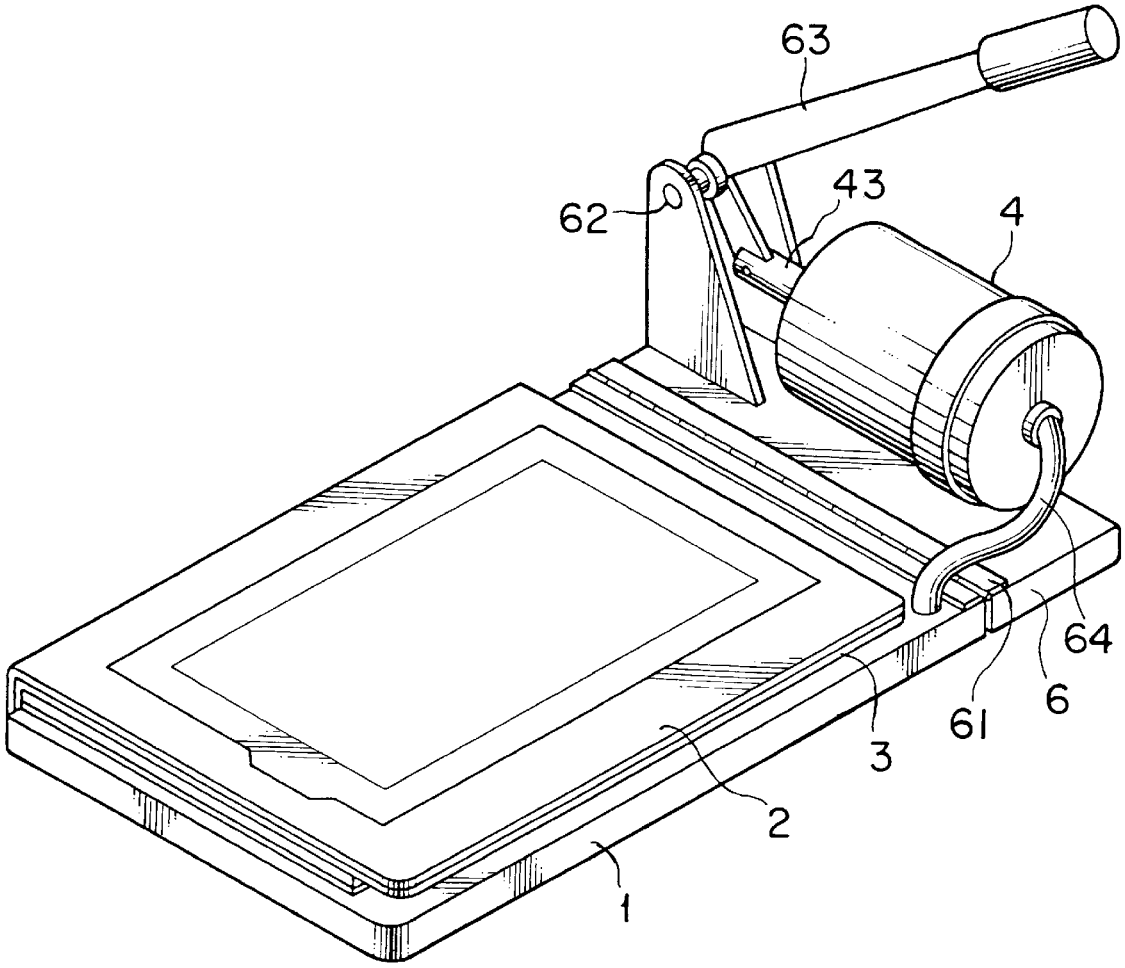
Figure 8:
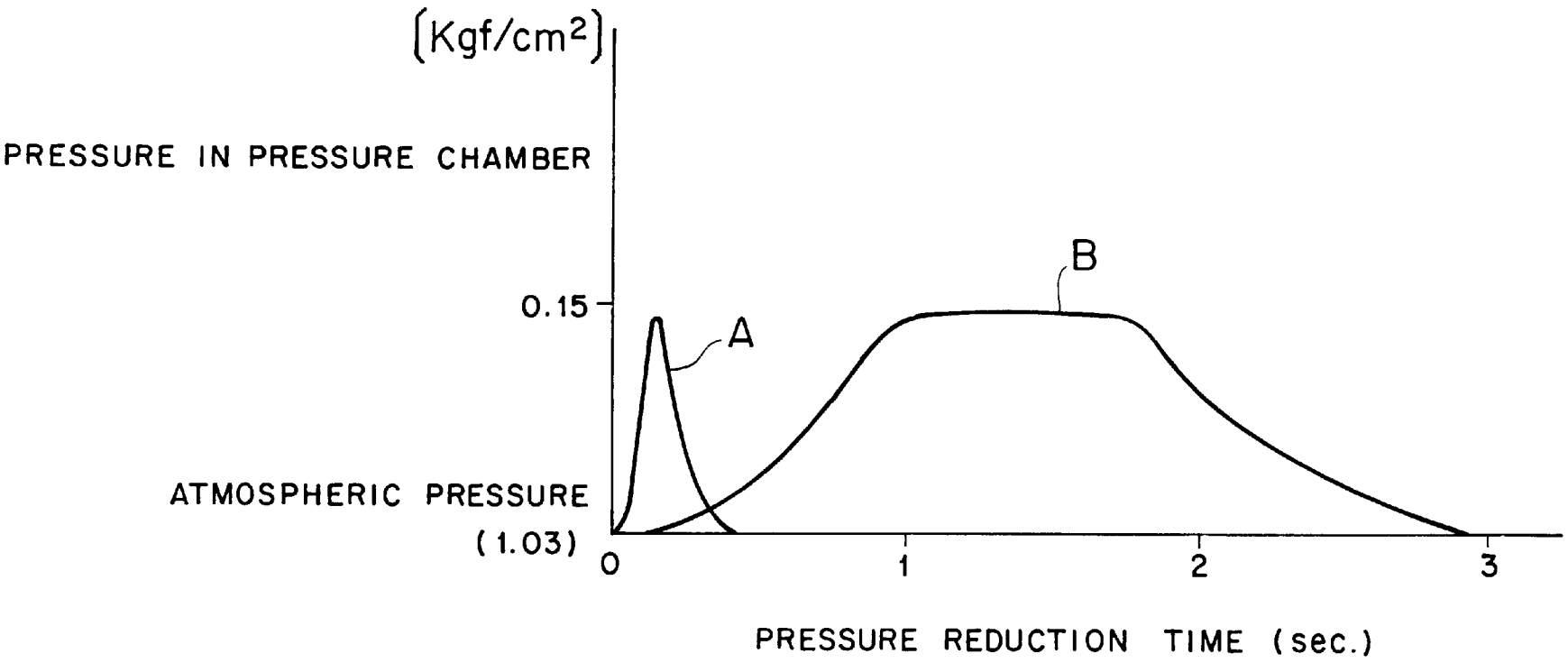
Figure 9:
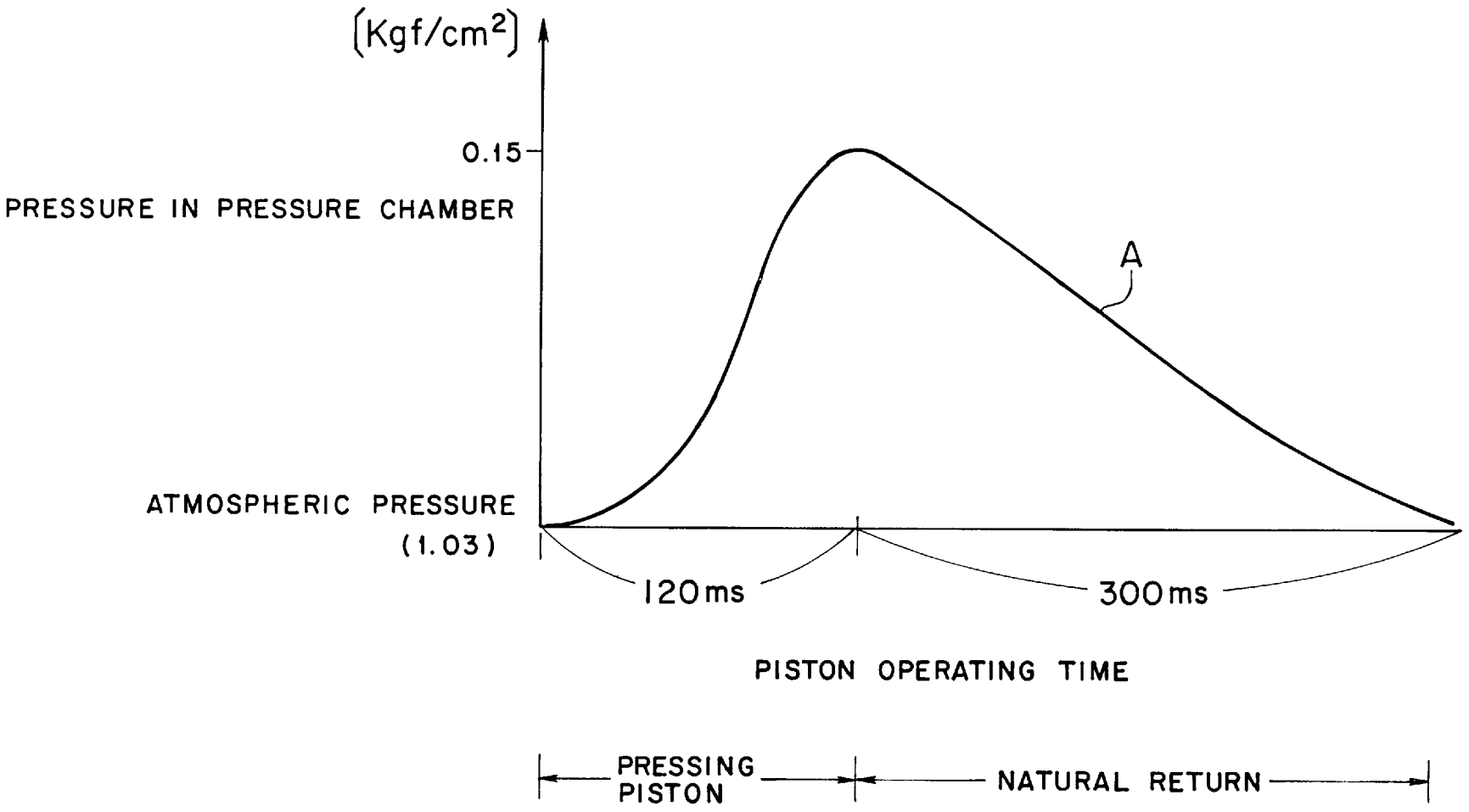

Hereinafter, the presently preferred embodiments of the present invention will be explained in detail with reference to the accompanying drawings, in which FIG. 1 is a schematic perspective view of an embodiment of the present stencil printing apparatus, FIG. 2 is a sectional view of the apparatus of FIG. 1, taken along the line II—II, FIG. 3 is a schematic perspective view of the apparatus of FIG. 1 in a state where the flexible sheet member is opened, FIG. 4 is a schematic perspective view of the apparatus of FIG. 1 in a state where the frame member is opened together with the flexible sheet member, FIG. 5 is a sectional view similar to FIG. 2, showing the apparatus of FIG. 1 in a state where the pressure chamber is depressurized, FIG. 6 is a sectional view similar to FIG. 2, showing another embodiment of the present stencil printing apparatus, FIG. 7 is a schematic perspective view of still another embodiment of the present stencil printing apparatus, FIG. 8 is a graph which shows a relation between pressure in the pressure chamber and pressure reduction time, and FIG. 9 is a graph which shows the curve A of FIG. 8 with the time scale being enlarged.

The embodiments shown in the drawings are presented only for illustrative purpose, and it should be construed that the present invention is not limited to these embodiments.

FIG. 1 shows an embodiment of the present stencil printing apparatus. In FIG. 1, the reference numeral 1 denotes a platform, the reference numeral 2 denotes a flexible sheet member, and the reference numeral 3 denotes a sheet-like frame member. The frame member 3 is laid on the upper surface of the platform 1. The flexible sheet member 2 is laid on the upper surface of the frame member 3. The flexible sheet member 2 and the frame member 3 are each hinged to the platform 1 so that each member can rotate about an edge of each member to be turned up and down. The platform 1, the flexible sheet member 2 and the frame member 3 can all be made of plastic materials. In this embodiment, the flexible sheet member 2 and the frame member 3 are made of polyvinyl chloride sheets of about 5 mm thick in order to enhance air-tightness between the two members. The frame member 3 is usually made harder than the flexible sheet member 3. The flexible sheet member 2 and the frame member 3 can be hinged by bonding the two members to the platform 1 and forming a folding or thin portion in the vicinity of the bonded portion of each member. In this embodiment, the hinged portion of each member is made of soft polypropylene. Alternatively, the flexible sheet member 2 and the frame member 3 may be connected to the platform 1 by use of mechanical hinges. In this way, a pressure chamber C of this stencil printing apparatus is obtained as a space which is defined by the platform 1, the flexible sheet member 2 and the frame member 3. The platform 1 is equipped on the upper surface thereof with an air pump 4 which is disposed adjacent to the flexible sheet member 2 and the frame member 3. The air pump 4 functions as a pressure reducing means for the pressure chamber C.

As shown in FIG. 2, the platform 1 of the apparatus of FIG. 1 is provided on the upper surface thereof with a frame-like plane member 13 which is fixed to the platform 1 opposite to the frame member 3. The frame-like plane member 13 is made of a magnetic material such as iron. In the opening of the frame-like plane member 13, a mount 11 made of an elastic material such as sponge is disposed on the platform 1 so that an article to be printed is placed thereon. The mount 11 has a plane upper surface of about A4 size (210×297 mm) so that printing is readily effected on pieces of paper, plastic sheets or the like. Meanwhile, a sticky layer 12 is formed on the upper surface of the mount 11 so that an article to be printed can stick to and be held on the mount 11.

As shown in FIG. 2, the frame member 3 of FIG. 1 is a laminate of a first frame member 31 which faces the flexible sheet member 2 and has a rectangular opening in the central portion thereof, and a second frame member 32 which faces the platform 1, has a rectangular opening in the central portion thereof and is bonded to the first frame member 31. Since the rectangular opening of the first frame member 31 is larger than the rectangular opening of the second frame member 32, the frame member 3 which has been made by laminating the two members 31 and 32 has a shoulder portion 33 that is formed by the inner edge portion of the second frame member 32 extending inwardly of the opening of the first frame member 31 on the side opposite to the platform 1. When a stencil is installed in the opening of the frame member 3, the edges of the stencil abut on the shoulder portion 33, and thus the shoulder portion 33 functions as a stencil supporting means.

In this instance, stencil unit 5 can advantageously be used as the stencil. As shown in FIG. 3, the stencil unit 5 is composed of a frame 52 made of cardboard, plastic or the like, a stencil sheet 51 which is extended on the frame 52, and an ink-impermeable cover sheet 52*a* which is affixed to the frame 52 so as to be turned up and down. Advantageously, the frame 52, which is relatively rigid, can abut on and be supported by the shoulder 33. The cover sheet 52*a* may be omitted if it is not necessary. Such a stencil unit 5 may have substantially the same structure as those disclosed in Japanese Utility Model Laid-open (Kokai) No. 132005/76 corresponding to U.S. Pat. No. 4,128,057 the disclosure of which is incorporated herein by reference and to which reference is to be made for details of the structure. The stencil sheet 51 may be a heat-sensitive stencil paper or sheet which is a laminate of an ink-impermeable thermoplastic film and a porous support of an ink-permeable sheet such as of Japanese paper or woven fabric.

In the embodiments shown in the drawings, the second frame member 32 is made of a magnetic rubber plate. Thus, when the frame member 3 is laid on the platform 1, it attracts the frame-like plane member 13 made of a magnetic material and comes in close contact with the member 13 so as to enhance air-tightness of the pressure chamber C.

As shown in FIG. 2, the air pump 4 of FIG. 1 comprises a cylinder 41 disposed on the upper surface of the platform 1, and a piston 42 slidably disposed inside of the cylinder 41. Thus, the piston 42 divides the inside of the cylinder 41 into a lower chamber 47 and an upper chamber 48. The piston 42 has a piston rod 43 which extends outwardly of the cylinder 41 through a hole 46 formed on the upper surface of the cylinder 41. The upper chamber 48 is sealed by providing an appropriate sealing means between the piston rod 43 and the hole 46. The piston rod 43 is provided at the top end thereof with a handle 44 so that the piston 42 can be moved manually. In the lower chamber 47, a coil spring 45 is interposed between the lower surface of the piston 42 and the bottom of the cylinder 41 so as to bias the piston 42 upwardly. The lower chamber 47 communicates with the outside via a suitable exhaust port (not shown). The upper chamber 48 communicates with a conduit 14 which is formed inside of the platform 1 and opens on the upper surface of the platform 1 in the vicinity of the mount 11.

When stencil printing is effected using the apparatus of FIG. 1, the flexible sheet member 2 is turned up as shown in FIG. 3, and then a perforated stencil unit 5 onto which ink lumps are placed is placed in the opening of the frame member 3. In this instance, the stencil unit 5 is supported by the frame member 3 since the frame 52 of the stencil unit 5 abuts on the shoulder portion 33. Then, when the flexible sheet member 2 is again laid on the frame member 3 as shown in FIG. 1, the stencil unit 5 is sandwiched and held between the frame member 3 and the flexible sheet member 2. When the frame member 3 is turned up together with the flexible sheet member 2 being layered over the frame member 3 as shown in FIG. 4, an article such as paper to be printed can be placed on the mount 11. The article to be printed is held by the sticky layer 12. When the handle 44 is pushed down by a hand, the pressure chamber C is depressurized. In this instance, the flexible sheet member 2 is bent downwardly, and press the ink placed on the stencil sheet 51, as shown in FIG. 5. Thus, ink is passed through the perforations of the stencil sheet 51 and transferred to the article to complete printing. After printing, the pressure chamber C takes air by way of gaps between the frame member 3 and the platform 1 or the flexible sheet member 2, and is finally returned to atmospheric pressure. Then, when the frame member 3 is again turned up together with the flexible sheet member 2, a printed article can be taken off the mount 11. If the stencil sheet 51 becomes short of ink after printing has been effected many times, ink can readily be supplied to the stencil sheet 51 after the flexible sheet member 2 is turned up over the frame member 3 as shown in FIG. 3.

Printing ink used herein is preferably an emulsion ink having a consistency sufficient to retain its shape, such as those having 32 or less of a flow value in one minute measured by a spreadometer, as disclosed in Japanese Patent Publication (Kokoku) No. 23601/79. The printing ink may further be thixotropic.

In the apparatus shown in the drawings, the pressure chamber C and the upper chamber 48 of the cylinder constitute a closed circuit in which the pressure chamber C and the upper chamber 48 communicate with each other only through the conduit 14. In addition, the apparatus is designed so that only one stroke of the piston 42 can achieve pressure reduction of the pressure chamber C sufficiently to effect printing. In other words, the upper chamber 48 is designed to have a stroke volume equal to or greater than the volume of the pressure chamber C, in which the stroke volume is a volume resulting from subtraction of the minimum volume of the upper chamber 48 from the maximum volume of the upper chamber 48, and the volume of the pressure chamber includes the volume of the conduit 14 and the minimum volume of the upper chamber 48. When the pressure reduction required for printing is achieved by one stroke of the piston 42, it is considered that depressurization is effected with increasing speed instantaneously. Thus, the present printing apparatus can provide a sharp printed image in a short time, compared with the case where a vacuum pump is used for depressurization.

FIG. 8 is a graph which shows time course of pressure in the pressure chamber when a conventional vacuum pump or an air pump was used, in which curve A indicates the case where an air pump was used, and curve B indicates the case where a vacuum pump was used. FIG. 9 shows the curve A of FIG. 8 with time scale being enlarged. As apparent from FIG. 8, it is shown that the air pump used according to the present invention took a short time to depressurize the pressure chamber to a predetermined pressure, compared with the vacuum pump. Pressure in the pressure chamber can be varied from about 0.05 to 0.150 (kgf/cm$^2$) depending upon pressing force exerted by an operator. The lower the pressure is, the higher the printing density is. Since leakage of air starts in 100 ms to 250 ms after the inception of pressing the piston, the slower, the pressing speed of the piston is, the weaker the peak of pressure reduction is. When movement of the piston is stopped, pressure in the pressure chamber automatically returns to atmospheric pressure in about 300 ms. Since the time during which depressurization occurs is in an order of milliseconds and very short, printing inks are prevented from unduly flowing and thus prints are obtained with little blurring and high quality.

FIG. 6 is a sectional view showing another embodiment of the present invention. The stencil printing apparatus of FIG. 6 is the same as the apparatus of FIGS. 1 to 5, except the structure of an air pump 4. The air pump 4 of the FIG. 6 is different from that of FIGS. 1 to 5 in that a coil spring 45 is interposed between the cylinder 48 and the piston 42 in the upper chamber 48 to bias the piston 42 downwardly, and the lower chamber 47 communicates with the pressure chamber C through the conduit$_{13}$14. In the apparatus of FIG. 6, therefore, pressure reduction of the pressure chamber C is effected by pulling the handle 44 upwardly to elevate the piston 41 upon printing.

FIG. 7 is a perspective view showing still another embodiment of the present invention. The stencil printing apparatus of FIG. 7 is the same as that of FIG. 6, except the structure of the air pump 4. The air pump 4 of the apparatus of FIG. 7 is an air pump which is laid down on a base 6 connected with a hinge 61 to the platform 1. While the inner structure of the air pump 4 of FIG. 7 is the same as that of FIG. 6, the former pump is different from the latter pump in that the piston rod 43 is rotatably connected with a pin to an end of a substantially L-shaped lever 63, and the lower chamber of the cylinder is connected via a tube 64 to the conduit 14. The lever 63 is pivotably supported at the curved portion thereof on a shaft 62 supported over the base 6, and constitutes a link mechanism for piston 42. Thus, pressure reduction of the pressure chamber C of the apparatus of FIG. 7 can be effected by pushing down the lever 63 upon printing. When the apparatus of FIG. 7 is not used for printing, the platform 1 may be turned up around the hinge 61 and kept vertically so as to reduce a space for storage. If a picture or photograph is affixed to the back side of the platform 1 or the back side is ornamented, the printing apparatus of FIG. 7 may be utilized for interior ornamental purpose.

According to the present invention, the pressure chamber is depressurized with increasing speed instantaneously only if an operator pushes down or pulls up the piston of the air pump. Thus, stencil printing is readily effected on articles placed in the pressure chamber. In addition, since the air pump has a simple structure composed of a cylinder and a piston, the printing apparatus can be made small-scale and lightweight, and the air pump may be integrated with the printing apparatus.

According to the present stencil printing apparatus, the pressure chamber is constituted by the three-layer structure of the platform, the frame member and the flexible sheet member, and thus it is possible to minimize the volume of the pressure chamber, thereby making the printing apparatus small-sized and lightweight. Thus, the pressure chamber is suitable to be depressurized by means of a small-sized air pump of the type mentioned above. Furthermore, only if the flexible sheet member is turned up, the stencil can readily be installed in or taken out of the frame member, and thus no complicated operation is required to replace the stencil.

What we claim is:

1. A stencil printing method which comprises placing a lump of printing ink on a side of a stencil, said printing ink having a consistency sufficient to retain its shape, disposing said stencil in a pressure chamber the wall of which is partly constituted by a flexible sheet member, while the side of said stencil on which said printing ink has been placed, faces said flexible sheet member, and reducing pressure in said pressure chamber to bring the flexible sheet member into close contact with the lump of printing ink and simultaneously bring the stencil into close contact with a surface to be printed, so that stencil printing is effected on the surface by virtue of pressure force exerted by the flexible sheet member, characterized in that pressure in the pressure chamber is reduced by means of an air pump which comprises a cylinder connected to said pressure chamber and a piston slidably disposed in said cylinder, wherein said piston of the air pump has a piston rod extending outwardly of said cylinder, the pressure in the pressure chamber is reduced by operating said piston rod, and said air pump has a sealed chamber of variable volume which is defined by said cylinder and said piston and is connected to said pressure chamber.

2. A method according to claim 1, in which said sealed chamber has a volume that meets the following equation (1):

$$V_1/V_2 \geqq 1 \quad (1)$$

wherein $V_1$ is a stroke volume of the sealed chamber, and $V_2$ is a volume of the pressure chamber in which said stencil has been disposed.

3. A method according to claim 2, in which printing is effected by pressure reduction in said pressure chamber caused by one stroke of said piston rod.

4. A stencil printing apparatus which comprises:

a pressure chamber the wall of which is partly constituted by a flexible sheet member, a mount which is disposed in said pressure chamber opposite to said flexible sheet member and on which an article to be printed is placed, means for supporting a stencil between said flexible sheet member and said mount, and means for reducing pressure in the pressure chamber, in which said means for reducing pressure is an air pump which comprises a cylinder connected to said pressure chamber and a piston slidably disposed in said cylinder, said piston of the air pump having a piston rod extending outwardly of said cylinder, and pressure in the pressure chamber is reduced by operating said piston rod, said air pump having a sealed chamber of variable volume which is defined by said cylinder and said piston and is connected to said pressure chamber.

5. A stencil printing apparatus defined in claim 4, in which said sealed chamber has a volume that meets the following equation (1):

$$V_1/V_2 \geqq 1 \quad (1)$$

wherein $V_1$ is a stroke volume of the sealed chamber, and $V_2$ is a volume of the pressure chamber in which said stencil has been disposed.

6. A stencil printing apparatus defined in claim 5, in which said piston rod is provided at its end outside of the cylinder with a handle which can be operated by a hand, and a spring is disposed between said piston and said cylinder to bias said piston rod in one direction.

7. A stencil printing apparatus defined in claim 5, in which said piston rod has an end which extends outside of the cylinder and is further connected to a link mechanism that reciprocates said piston.

8. A stencil printing apparatus defined in claim 4, in which said pressure chamber comprises a platform having a central portion on which a sheet to be printed is placed and a plane portion which surrounds said central portion, a frame member which is laid on said plane portion of said platform and having an opening that faces said central portion of said platform, a flexible sheet member which is laid on said frame member to cover said opening, said flexible sheet member being hinged at an end thereof to said platform so as to be turned up and down, said frame member being hinged at an end thereof to said platform so as to be turned up and down, and said stencil supporting means being a shoulder portion which is formed by extending an inner edge portion of said frame member inwardly of said opening on a side of the platform.

9. A stencil printing apparatus defined in claim 8, in which said frame member is a laminate of a first frame member and a second frame member, said first frame member being disposed opposite to said flexible sheet member and provided with an opening in the central portion thereof, and said second frame member being disposed opposite to said platform and provided in the central portion thereof with an opening which is smaller than said opening of the first frame member so that said second frame member forms said shoulder portion by the inner edge portion thereof that extends inwardly of the opening of the first frame member.

10. A stencil printing apparatus defined in claim 9, in which the second frame member is made of a magnetic rubber plate, and said plane portion of said platform is made of a magnetic material that attracts the second frame member.

11. A stencil printing apparatus defined in claim 10, in which said stencil is a stencil unit comprising a frame on which a stencil sheet is extended, and the stencil unit is received in the opening of the first frame member while said frame of the stencil abuts on said shoulder portion.

12. A stencil printing apparatus which comprises a pressure chamber and a means for reducing pressure in said pressure chamber, said pressure chamber comprising a platform having a central portion on which a sheet to be printed is placed and a plane portion which surrounds said central portion, a frame member which is a plate laid on said plane portion of said platform and having an opening that faces said central portion of said platform, and a flexible sheet member which is laid on said frame member to cover said opening, said flexible sheet member being hinged at an end thereof to said platform so as to be turned up and down, and said frame member being hinged at an end thereof to said platform so as to be turned up and down, in which said stencil printing apparatus further comprises a stencil supporting means which comprises a shoulder portion formed by extending an inner edge portion of said frame member inwardly of said opening on a side of the platform.

* * * * *